US006042105A

United States Patent [19]

Peulen

[11] Patent Number: 6,042,105

[45] Date of Patent: Mar. 28, 2000

[54] METHOD AND APPARATUS FOR ROTATING AN ADVANCING SHEET

[75] Inventor: Johannes E. P. Peulen, Belfeld, Netherlands

[73] Assignee: Océ-Technologies B.V., Venlo, Netherlands

[21] Appl. No.: 08/953,489

[22] Filed: Oct. 17, 1997

[30] Foreign Application Priority Data

Oct. 17, 1996 [NL] Netherlands ..... 1004297

[51] Int. Cl.[7] ..... B65H 29/00; B65H 9/00

[52] U.S. Cl. ..... 271/184; 271/185; 271/226

[58] Field of Search ..... 271/184, 185, 271/226

[56] References Cited

U.S. PATENT DOCUMENTS

| | | | |
|---|---|---|---|
| 4,445,679 | 5/1984 | Bay | 271/185 |
| 4,669,719 | 6/1987 | Fratangelo | 271/185 |
| 4,928,807 | 5/1990 | Auerbach | 271/185 |
| 5,172,907 | 12/1992 | Kalisiak | 271/184 |
| 5,320,340 | 6/1994 | Bay | 271/184 |
| 5,427,367 | 6/1995 | Kimura et al. | 271/185 |

FOREIGN PATENT DOCUMENTS

| | | | |
|---|---|---|---|
| 0248844 | 11/1986 | Japan | 271/185 |
| 0132041 | 5/1990 | Japan | 271/184 |
| 0270746 | 11/1990 | Japan | 271/185 |
| 403152045 | 6/1991 | Japan | 271/184 |

*Primary Examiner*—William E. Terrell
*Assistant Examiner*—Wonki K. Park

[57] ABSTRACT

A sheet advancing over a transport plane by pairs of transport rollers is rotated through an angle of 90° by retaining the sheet at a point of rotation coupled with the releasing of one of the transport roller pairs so that only the other transport roller pair exerts a torque on the sheet. By disposing the other of the transport roller pairs exerting the torque somewhat downstream of the center of rotation, the sheet is maintained taut during rotation.

7 Claims, 4 Drawing Sheets

METHOD AND APPARATUS FOR ROTATING AN ADVANCING SHEET

BACKGROUND AND SUMMARY OF THE INVENTION

The present invention relates to a method of rotating a sheet advanced in a straight line in the direction of the advance, in a transport plane, by transport means, by retaining the sheet at a center of rotation. A method of this kind is known from U.S. Pat. No. 4,445,679 which describes a method in which during retention of an advancing sheet at the center of rotation, a slip occurs between the sheet transport means and the sheet. The sheet transport means must be able to allow such a slip, e.g. by making the transport means relatively smooth and/or by pressing it against the sheet with a relatively minor force. In these conditions there is the risk that when a sheet which has a relatively smooth surface is rotated, the sheet will slip as a whole so that the required rotation becomes incomplete. In the case of the rotation of a relatively thin sheet and/or a sheet with a rough surface, the sheet will not slip but will tear or crease.

Accordingly, the object of the present invention is to provide a method and apparatus which does not have these disadvantages.

The present invention is characterized in that during the rotation of the paper, the transport means forms solely a first transport nip which, when considered in a direction transverse to the direction in which the sheet is advanced in a straight line, is situated at a fixed distance from the center of rotation on a line between the first transport nip and said center of rotation which line includes an angle of between 70 and 90° with respect to the direction of the advancing sheet. Consequently, a sheet can be reliably rotated in a simple manner with the sheet transport means operating continuously. Preferably, the angle is between 75 and 85°. Consequently, the frictional force exerted by the sheet transport means on the sheet during the rotation thereof has a small component which keeps the sheet taut between the center of rotation and the first transport nip so that creasing of the paper is advantageously avoided, but without said small component becoming so large that the sheet or the image thereon is damaged.

Furthermore, preferably and prior to and subsequent to the execution of a rotary movement, the sheet is also advanced through a second transport nip which, when considered in the direction in which the sheet advances in a straight line, is in an identical position to the first transport nip. This minimizes the risk of skewing before and after rotation.

The apparatus for performing the present method comprises retaining means movable between a first position which are free of an advancing sheet and a second position in which they retain the sheet at the center of rotation, and is characterized in that coupling means are provided between the retaining means and the sheet transport means. Upon movement of the retaining means from the first position to the second position, the sheet transport means moves from a position in which the second transport nip is closed to a position in which the second transport nip is open. This is a simple construction to ensure that no slipping of the transport nip occurs during the rotation of the sheet of paper.

If the first and second transport nips are formed by two pressure rollers fixed on a common shaft and if the shaft is lifted at the second transport nip when the second transport nip is opened, the pressure roller is shifted upwards from the first transport nip to form a punctiform first transport nip which further reduces the slip in the first transport nip.

In an attractive embodiment of the apparatus according to the present invention, the first transport nip is situated at a predetermined distance from an upstream sheet feed nip which is smaller than the length of the shortest sheet for processing and a sheet discharge nip situated downstream of the first transport nip is located at a predetermined distance from the sheet feed nip which is somewhat greater than the length of the diagonal of the largest sheet for rotation. Consequently, a sheet is rotated about the center of rotation a short distance from the original leading edge and the sheet edge, which becomes the leading edge after the rotation of a quarter revolution is situated at a greater distance downstream of the center of rotation so that the sheet can be discharged relatively rapidly from the rotational zone.

BRIEF DESCRIPTION OF THE DRAWINGS

Other features and advantages of the invention will be explained with reference to the accompanying drawings wherein.

DETAILED DESCRIPTION OF THE INVENTION

Figure 1:
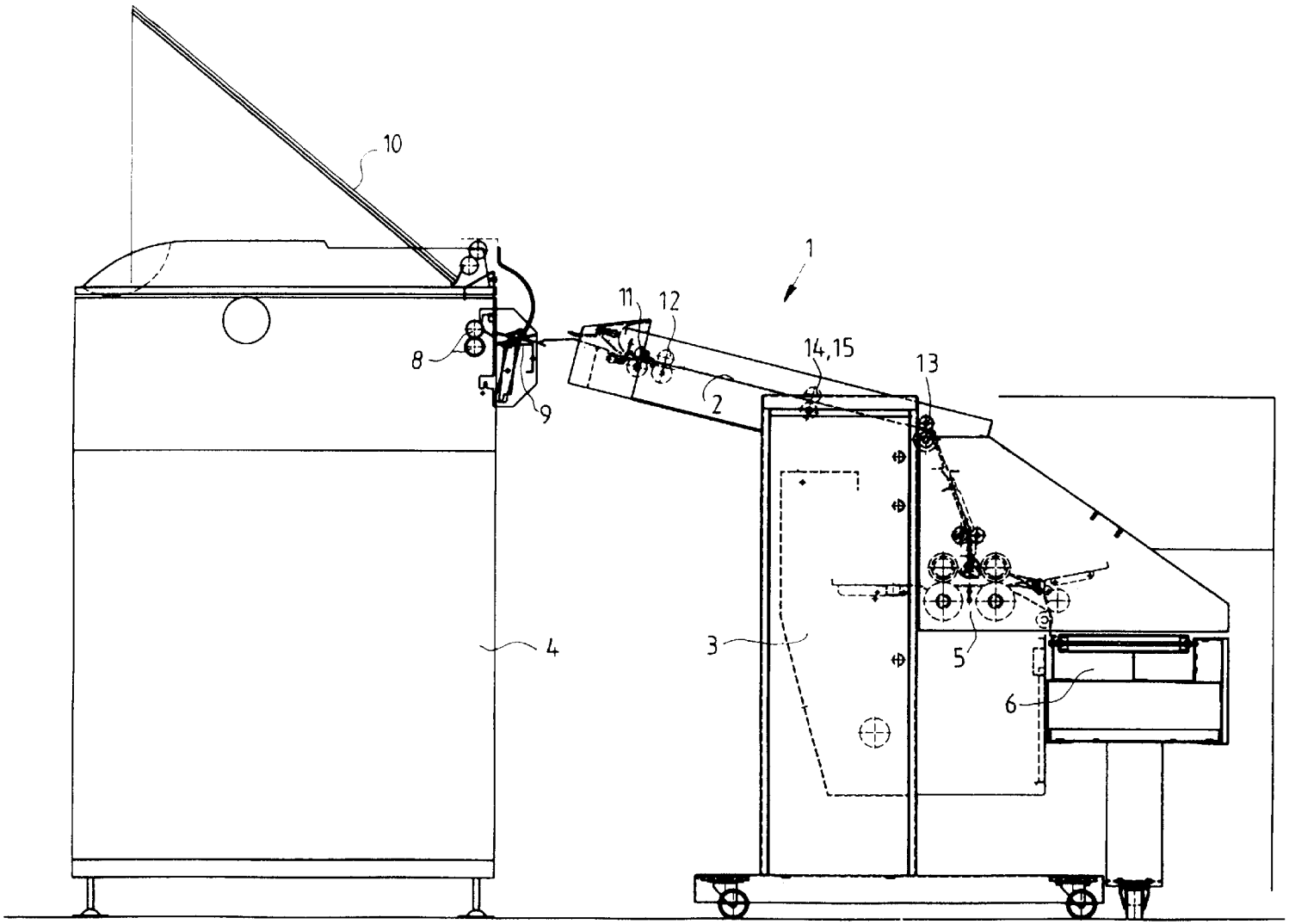
FIG. 1 is a side elevation of the rotating device according to the present invention disposed between a printing apparatus and a folding device.

The rotating device 1 shown in FIG. 1 is incorporated in a feed table 2 of a folding device 3. Along the feed table 2, copy sheets coming from a printing apparatus 4 are fed directly to the folding device 3. The printing apparatus 4 is of the type in which sheets of receiving material of different (standard) formats pass through in the longitudinal direction, i.e. with their shortest side as the leading edge, so that they can be readily folded into a packet.

As described in the above-mentioned U.S. Pat. No. 4,445,679, it is preferable to feed a sheet having the dimensions of a folded packet in the transverse direction to the folding device 3, i.e. a sheet having its longest side as the leading edge. However, in the case of the printing apparatus 4, in which a powder image is fused on a receiving sheet by means of radiant heat, the radiation fuser required for this purpose requires a minimum length when considered in the sheet transit direction, for the radiation power to be supplied. In the case when using a radiation fuser of this minimum required length, the distance between the transport rollers at the radiation fuser inlet and outlet may be too small to pass sheets which do not require folding in the transverse direction. In this case, this group of sheets, for example a group of sheets including the A4 format, must be fed longitudinally through the printing apparatus 4. For the sake of uniformity in inputting sheets it is also logical to feed all sheet formats for processing to the printing apparatus in the same orientation.

The folding device 3 is conventionally arranged to fold a supplied sheet into a packet of dimensions corresponding to the smallest standard format, e.g. the A4 format. The folding device of the type shown in FIG. 1 is illustrated and described in greater detail in European Patent 0 472 234. The folding device 3 of this type comprises a first folding section 5, in which a sheet fed longitudinally over the feed table 2 is folded zig-zag, the distance between two consecutive folds corresponding to the dimension of the shortest side of the smallest standard format, e.g. a size of 210 mm in the case of the A4 format. In a second folding section 6, the zig-zag folded sheet is folded in a direction at right angles to the first folds to the size of the longest side of the smallest standard format, i.e. to a size of 297 mm in the case of an A4 format. A copy sheet supplied in the smallest standard format, e.g. an A4 format, can be left unfolded. To this end, if such a sheet is passed through the folding device 3, so that the sheet can be placed on folded sheets so as to cover the same, the sheet must be fed transversely to the folding device 3.

In order, in the case of a folding device 3 coupled on-line to the printing apparatus 4, to allow both for the above requirements of the printing apparatus 4 with respect to the orientation of the smallest standard format, and the requirements of the folding device 3 with respect to the orientation of the smallest standard format, the feed table 2 is provided with a rotating device 1, which will be described with reference to FIGS. 3 to 6, which rotates a sheet of the smallest standard format fed longitudinally through the printing apparatus, through a quarter revolution so that the sheet can be fed transversely into the folding device 3.

The printing apparatus 4 is provided with a pair of outlet rollers 8. Downstream thereof is a deflector 9 which in the position shown in FIG. 1 deflects a copysheet upwards for deposition onto a tray 10 sloping above the printing apparatus 4. The deflector 9 can also be set to a position in which a copy sheet can be fed in the direction of the feed table 2 of the folding device 3.

Figure 2:
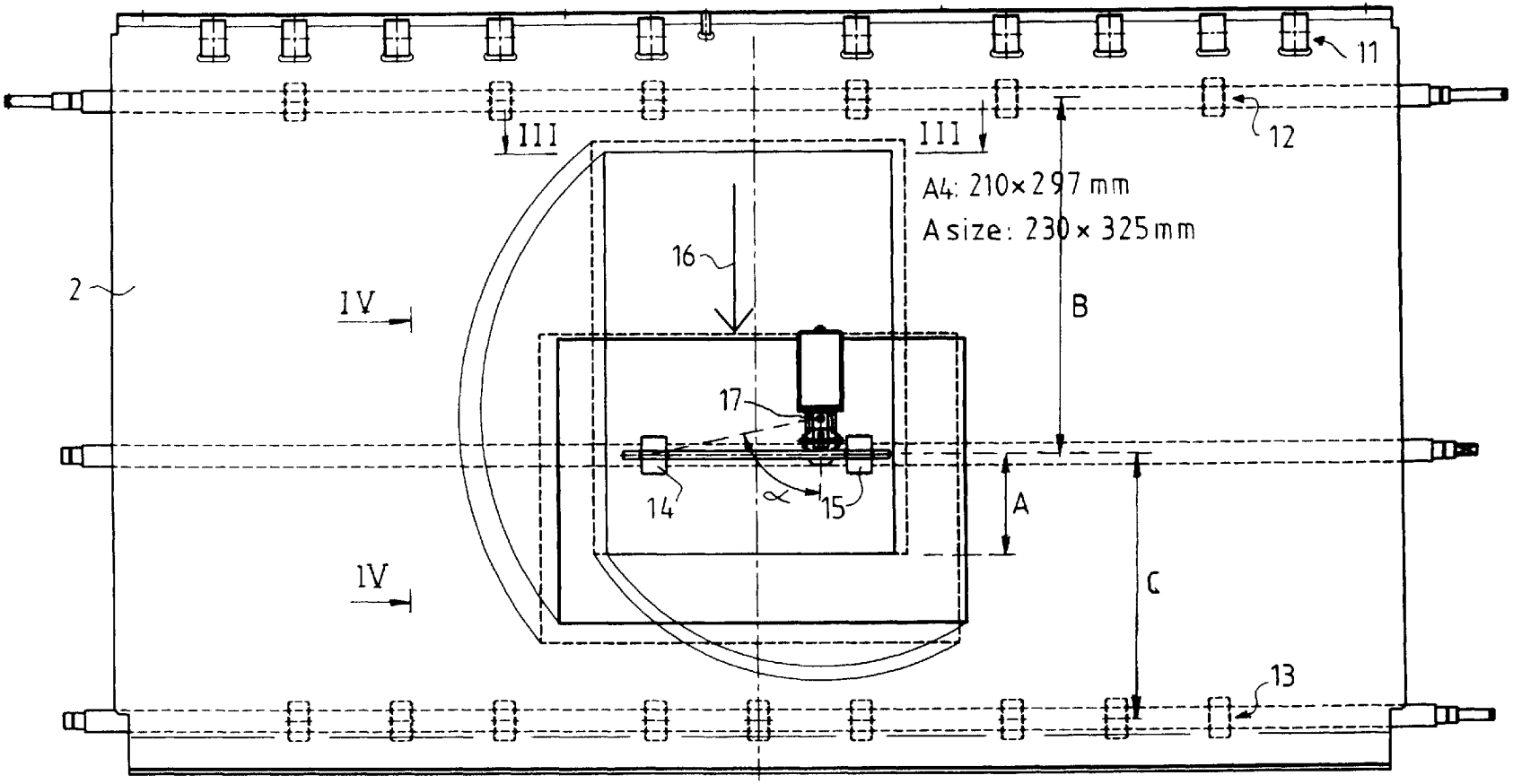
FIG. 2 is a cross-section on the line III—III in FIG. 2, shown in a position in which a sheet advances in a straight line.

On the upstream side, the feed table 2 is provided with pairs of transport rollers 11 and 12 while on the downstream side it is provided with a pair of transport rollers 13. The pairs of rollers form a plurality of transport nips distributed over the width of the feed table 2, as shown in FIG. 2. Between the pairs of transport rollers 12 and the pair of transport rollers 13, two additional pairs of transport rollers 14 and 15 are disposed next to one another which, in addition to advancing the sheets over the feed table 2 for folding, also have a function in connection with rotating a sheet, as will be described hereinafter.

Copy sheets printed in the printing apparatus 4, which are larger than a group of sheets for passage unfolded by the folding device 3, are fed in a straight line over the feed table 2 by all the transport roller pairs 11 to 15 in the direction indicated by arrow 16 in FIG. 2.

When a copy sheet is supplied belonging to a group of sheets having a format requiring no folding, said sheet is turned through a quarter revolution on the feed table 2 in the manner to be explained hereinafter.

Rotation of a sheet on the feed table 2 is carried out when the sheet reaches the transport nip between the pairs of transport rollers 14 and 15. Rotation then takes place by retaining the sheet near one of said transport nips, namely near the transport nip formed by the transport roller pair 15, and releasing the transport rollers 15 from one another so that transport rollers 14 rotate the sheet about the center of rotation 17.

During rotation, the sheet must remain free from the transport rollers 12 acting as input rollers and the transport rollers 13 acting as output rollers. In order to minimize the risk of the sheet being fed in a skewed position by the pairs of transport rollers 14 and 15 in the case of the transportation of a sheet which does not require rotation, it is important that these pairs of transport rollers 14 and 15 should be as far apart as possible looking in a transverse direction to the transit direction 16. In the case of an A4 sheet fed in the longitudinal direction and having a width of 210 mm, the transport roller pairs can be up to approximately 150 mm apart to ensure that any laterally shifted sheet can be transported by the two pairs of transport rollers 14 and 15. In order to further ensure that a sheet is situated with its central line substantially on the same line in the transit direction 16 both before and after rotation through 90°, the center of rotation 17 should be situated on a line which, calculated from the center of the sheet for rotation, lies on a line forming an angle of 45° with the sheet sides. On the basis of the above considerations, the distance between the transport nips 14 and 15 and the location of the center of rotation 17 somewhat upstream of the nips 14 and 15, a sheet for rotation must be transported with its leading edge over a distance A=75 mm past the pairs of transport rollers 14 and 15 before rotation starts. This means that for the rotation of the largest sheet for rotation, which has a length B=325 mm, the transport rollers 14 and 15 must be located at a distance downstream of the input rollers 12 which should be at least B−A=325−75=250 mm. Since the distance between the center of rotation 17 and the point of the leading sheet edge situated furthest away from said center of rotation in the case of the largest format of the group of sheets for rotation in a size of 325×230 mm is equivalent to approximately 200 mm, the distance C between the transport roller pairs 14 and 15 and the output rollers 13 should also be approximately 200 mm. Consequently the distance between the input rollers 12 and the output rollers should be at least B−A+C. In the case of the maximum sheet format for rotation, i.e. 325×230 mm, this is therefore 325−75+200=450 mm. With some clearance between the leading and trailing edge of the sheet and the output rollers 13 and input rollers 12 respectively, a suitable free space for rotation between the input and output rollers is 460 mm. For rotation of a sheet, the center of rotation 17 on the feed table 2 is formed by pressing the sheet with a rounded rubber cup against the feed table and simultaneously or slightly prior thereto opening the transport nip between the transport rollers 15 closest to the center of rotation 17. Given the continuous drive of the transport rollers 14 and 15, the transport nip 14 situated furthest away from the center of rotation 17 rotates the sheet about the formed center of rotation.

The opening of the transport nip is effected by lifting close to the pair of transport rollers 15 a shaft forming the connection between the pressure rollers of the pairs of transport rollers 14 and 15 using a lever having at one end the rubber cup forming the center of rotation and, at the other end a lug as will be explained hereinafter with reference to the embodiment illustrated in FIGS. 3 to 5. As illustrated in the top plan view of the feed table 2, a suitable location for the center of rotation 17 is on the connecting line between the center point of the sheet at the start of the rotation and the transport nip 15 for opening, the location being a short distance from said nip e.g. 40 mm. By tipping the connecting shaft between the pressure rollers of the pairs of transport rollers 14 and 15 on opening of the nip 15, the other nip 14 will form a more punctiform nip, which is advantageous for slip-free transportation during rotation of the sheet. Since the punctiform transport nip 14 is also situated a short distance downstream of the center of rotation 17 as viewed in the transit direction, said transport nip 14 exerts a small tractive force on the sheet, and this holds the sheet taut during rotation between the nip 14 and the center of rotation 17.

Figure 4:
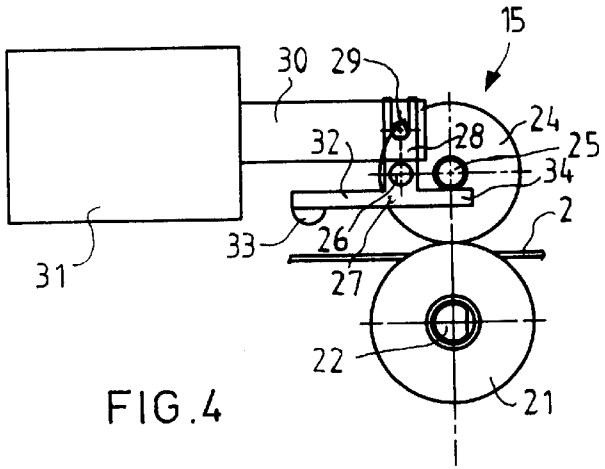
FIG. 4 is a side elevation on the line IV—IV in FIG. 2 shown like FIG. 3 in a position in which the sheet moves forward in a straight line.
Figure 6:
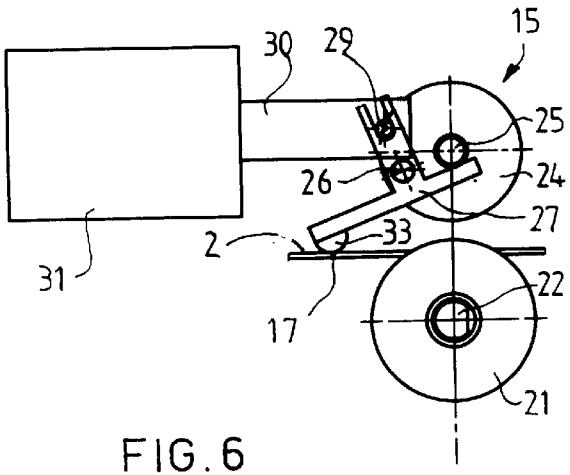
FIG. 6 is a side elevation of FIG. 4 shown like FIG. 5 in the position in which a sheet undergoes a rotary movement.
Figure 3:
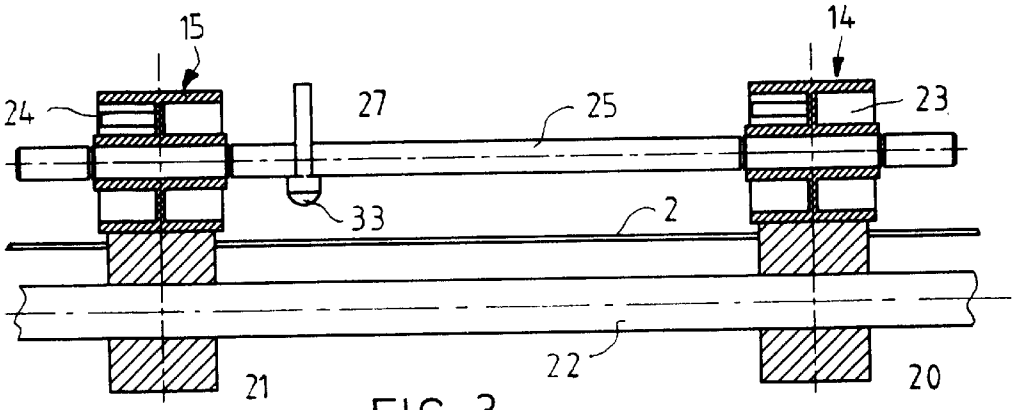
FIG. 3 shows the rotating device 1 of FIG. 2 in a position for passing a sheet in a straight line.
Figure 5:
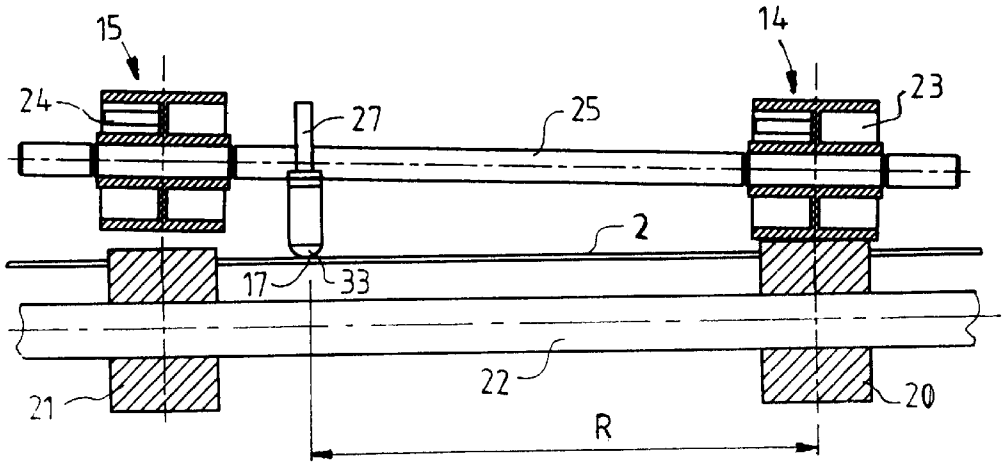
FIG. 5 is a cross-section on FIG. 3 shown in a position in which a sheet undergoes a rotary movement.

FIGS. 3 and 4 show the rotating device 1 of FIG. 2 in a position for passing a sheet in a straight line 16 through the rotating device. This position is occupied both on the passage of a copy sheet which has to be folded in the adjoining folding device 3 and on the transport of a sheet for rotation prior to and following the rotation of the sheet.

The rotating device 1 comprises two pairs of transport rollers 14 and 15. Each pair of transport rollers 14 and 15 consists of a driven roller 20, 21 respectively fixed on a common drive shaft 22. Rollers 20 and 21 project somewhat above the feed table 2 formed by a plate. Each drive roller 20, 21 co-operates with a biasing roller 23, 24 respectively to form a transport nip. Biasing rollers 23, 24 are fixed on a common shaft 25 which fits by journals at its ends into slots (not shown) extending vertically.

Near the shaft 25 is disposed a pin 26 fixed in the apparatus frame. A T-shaped element 27 is fixed rotatably about said pin 26. The upwardly projecting arm 28 thereof is provided with a U-shaped recess in which a pin 29 fits which is fixed on an arm 30 movable back and forth between two positions by means of a solenoid 31. One arm 32 of the T-shaped element 27 is provided at its underside with a rounded rubber cup 33 and another arm 34 is situated beneath the shaft 25, so that arms 32 and 34 act as a lever. To perform a rotary movement, the solenoid 31 is actuated so that the T-shaped element 27 moves against spring action from the position shown in FIGS. 3 and 4 to the position shown in FIGS. 5 and 6. In this condition, arm 34 tilts shaft 25 up at the side of pressure roller 24 so that the transport nip between the rollers 21 and 24 is opened. On rotation of the T-shaped element 27, the rubber cup 33 is also pressed against the sheet lying on the feed table 2. Thus cup 33 forms the center of rotation 17 around which the sheet rotates on the continuous transportation of the sheet through transport rollers 20 and 23. As a result of the tilting of the shaft 25, biasing roller 23 presses, as already stated, against the drive roller 20 at substantially one point so that the angular velocity at which the sheet rotates is determined by the radius R. After the sheet has been turned through an angle of 90°, the rotation time being $$t = 90° \cdot \frac{R}{V}$$

where V is the circumferential speed of the drive roller 20, the solenoid 31 is de-energized so that biasing roller 24 again forms a transport nip and the center of rotation 17 is cancelled.

Figure 7:
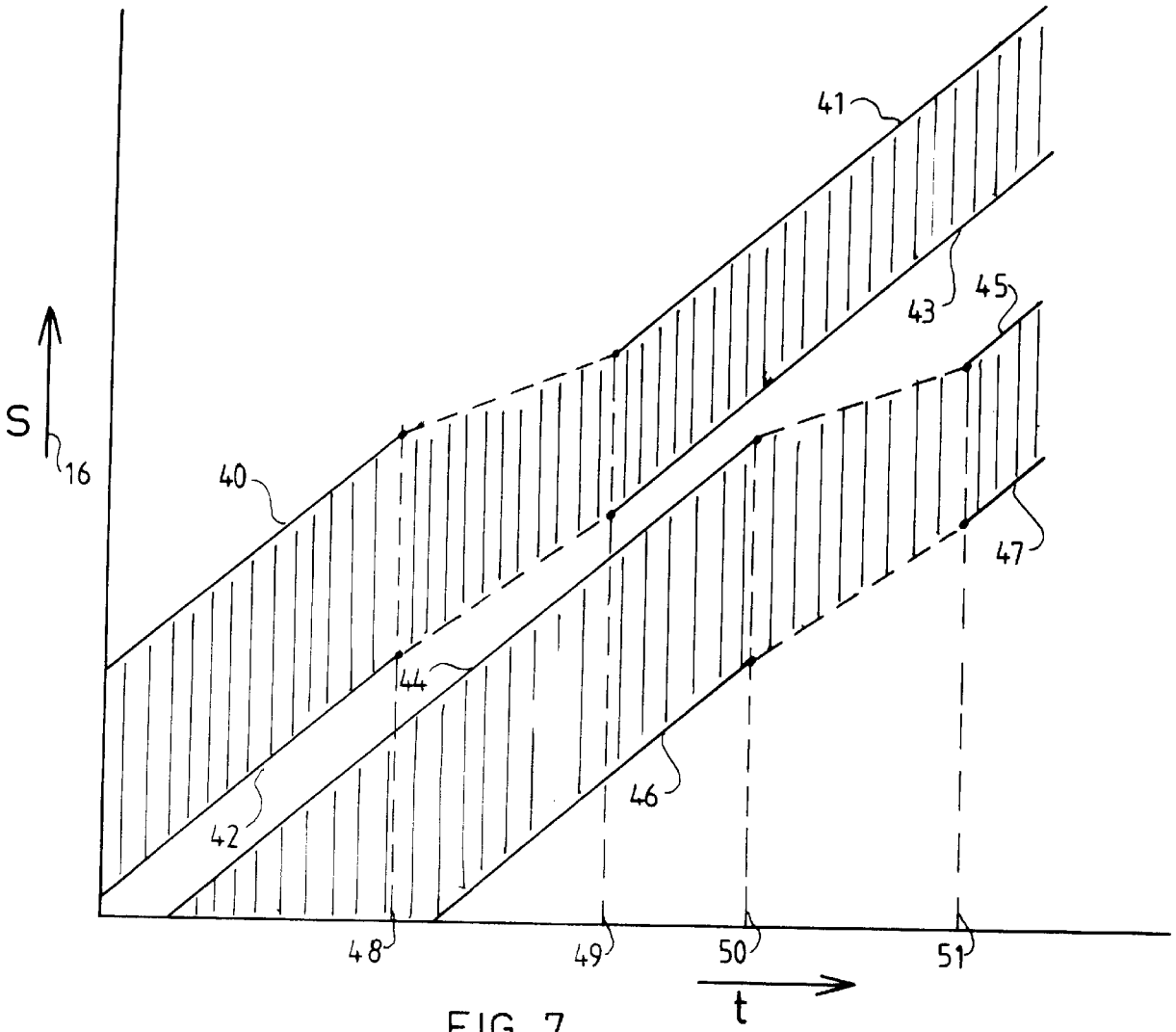
FIG. 7 is a time/distance diagram of sheets during the rotary movement according to the invention.

As shown in the distance/time diagram in FIG. 7, the sheet moves forward during rotation, as a result of the situation of the center of rotation 17 on the leading half of the sheet fed in the longitudinal direction and at the side of the sheet so that the distance between the center of rotation and the original leading edge is less than the leading edge after rotation. As a result of the continuous advance during rotation, a subsequent sheet can be supplied a short distance S after the rotating sheet without obstructing the latter, as will be apparent from FIG. 7.

In FIG. 7, the leading edge of a first sheet is indicated before rotation by line 40 and after rotation by line 41. The trailing edge is denoted by line 42 before rotation in FIG. 7 and by line 43 after rotation. For a subsequent sheet supplied at a distance S from the first sheet, the leading edge is denoted by lines 44 and 45 respectively and the trailing edge by lines 46 and 47 respectively. The starting and stopping time of the rotation of the first sheet is at the times 48 and 49 and for the next sheet is at times 50 and 51.

The angle $\alpha$ which forms the included angle between the direction in which the sheet moves straight ahead and the line between the transport nip which remains continuously operative and the formed center of rotation can vary within specific limits without affecting good operation.

In the case of a 90° angle $\alpha$, the transport force operative in the transport nip is at right angles to the line between said nip and the center of rotation of the sheet. Thus under ideal conditions there is no slip in the transport nip. In the case of a 70° angle $\alpha$, the transport force in the nip can be broken down into a rotating force at right angles to the line between the nip and the center of rotation and a (small) force operative in extension of said line and holding the sheet taut. If the angle $\alpha$ is too small, the latter force may produce unwanted slip in the transport nip. In the case of an angle $\alpha$ between the above limits, e.g. an angle $\alpha$=80°, a compromise can be found in which the sheet is maintained taut during rotation without appreciable slip occurring in the transport nip, of course with some deformability of at least one of the transport rollers in the transport nip.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of rotating a sheet in the same plane as the direction in which the sheet is being advanced, utilizing first and second transport means operatively associated with a feed table for moving said sheet on said feed table which comprises:

retaining the sheet at a center of rotation;

releasing the first of said transport means from active engagement with the advancing sheet;

maintaining the second of said transport means in active engagement with the advancing sheet causing the sheet to rotate about the center of rotation, said second transport means, when viewed in a direction transverse to the direction in which the sheet is being advanced, being positioned at a fixed distance from the center of rotation on a line between said second transport means and said center of rotation, which line defines an angle $\alpha$ of between 75° and 85° with respect to the direction of the advancing sheet.

2. The method of claim 1, wherein prior to and subsequent to the execution of the rotation of the sheet, the sheet is advanced through the second transport means which, when considered in the direction of the advancing sheet, is in the same position as the first transport means.

3. The method of claim 1, wherein the sheet is rotated through a quarter of a revolution.

4. An apparatus for rotating a sheet in the same plane as the direction in which the sheet is being advanced, which comprises:

a feed table, defining a transport plane;

first and second transport means operatively associated with said feed table for moving said sheet on said feed table;

means associated with said feed table for temporarily retaining the sheet at a center of rotation;

means for releasing the first of said transport means from active engagement with the advancing sheet;

means for maintaining the second of said transport means in active engagement with the advancing sheet, causing the sheet to rotate about said center of rotation, said second transport means, when viewed in a direction transverse to the direction in which the sheet is being advanced, being positioned at a fixed distance from the center of rotation on a line between said second transport means and said center of rotation, which line defines an angle $\alpha$ of between 75° and 85° with respect to the direction of the advancing sheet.

5. The apparatus of claim 4, wherein additional transport means are operatively associated with said feed table upstream of said first and second transport means, wherein the second transport means is disposed a predetermined distance from said upstream, additional transport means which is less than the length of the shortest sheet for processing and the first transport means is disposed downstream of the second transport means at a distance from said additional transport means which is somewhat greater than the diagonal of the largest sheet of rotation.

6. The apparatus of claim 4, wherein the retaining means is movable between a first position which is free of an advancing sheet and a second position which engages and retains the sheet at the center of rotation, and wherein coupling means are provided between the retaining means and the first and second sheet transport means, whereby upon the movement of the retaining means from the first position to the second position, the first transport means is moved from a closed position to an open position.

7. The apparatus of claim 6, wherein the first and second transport means comprises pressure rollers fixed on a common shaft, said pressure rollers being disposed in opposing relationship to drive rollers disposed beneath the feed table, and wherein the coupling means contains an arm which moves the common shaft against the spring action at the side of the pressure roller forming the second transport means, upon movement of the retaining means from the first inactive position to the second active position.

* * * * *